US005332488A

United States Patent [19]

Mitsuji

[11] Patent Number: 5,332,488

[45] Date of Patent: Jul. 26, 1994

[54] SURFACE TREATMENT FOR IRON-BASED PERMANENT MAGNET INCLUDING RARE-EARTH ELEMENT

[75] Inventor: Katsuo Mitsuji, Alma, Mich.

[73] Assignee: Hitachi Magnetics Corporation, Endmore, Mich.

[21] Appl. No.: 24,519

[22] Filed: Mar. 1, 1993

Related U.S. Application Data

[63] Continuation of Ser. No. 750,609, Aug. 27, 1991, abandoned.

[51] Int. Cl.[5] ..... C25D 5/00

[52] U.S. Cl. ..... 205/181; 205/182; 205/170; 148/265

[58] Field of Search ..... 205/210, 271, 273, 119, 205/170, 181, 182; 204/181.1, 181.3; 148/265

[56] References Cited

U.S. PATENT DOCUMENTS 4,328,046 5/1982 Fuchs ..... 148/6.2
5,013,411 5/1991 Minowa et al. ..... 205/119

FOREIGN PATENT DOCUMENTS 166393 12/1981 Japan .
268004 10/1989 Japan .

*Primary Examiner*—John Niebling
*Assistant Examiner*—Kishor Mayekar
*Attorney, Agent, or Firm*—Vineet Kohli; Thomas R. Morrison

[57] ABSTRACT

A magnetically anisotropic magnet substrate is coated with at least one layer of nickel plating followed by a chromate layer. The chromate top layer improves the corrosion resistance of the coated magnet substrate. In a preferred embodiment, the layer of nickel plating includes a first layer of a non-bright nickel plating followed by a second layer of a semi-bright nickel plating. One embodiment adds a copper under-layer below the nickel plating.

7 Claims, No Drawings

SURFACE TREATMENT FOR IRON-BASED PERMANENT MAGNET INCLUDING RARE-EARTH ELEMENT

This application is a continuation application of application Ser. No. 07/750,609 filed Aug. 27, 1991, now abandoned.

BACKGROUND OF THE INVENTION

The present invention relates to an improved surface treatment for an iron-based permanent magnet including rare-earth elements.

More particularly the invention relates to a permanent magnet having high resistance to mechanical attack, thermal attack and/or chemical attack, and also having excellent magnetic properties.

Permanent magnet materials are very important electric and/or electronic materials to be incorporated in various equipments such as consumer electronic equipment used in homes, motor vehicles and peripheral terminal devices for computers.

Recently because of the tendency to reduce the size and to enhance the efficiency of the equipment in which permanent magnets are used, more and more improvement in the characteristics of permanent magnet materials are required.

A new type of high efficiency magnet, which does not include highly expensive samarium and cobalt, uses R—Fe—B type (where R is one element or a mixture of rare-earth elements including yttrium).

This type of magnet exhibits an extremely high energy product ((BH)max) of 25 MGOe or more. It includes light rare-earth elements such as Nd and/or Pr and Fe as its main constituent element.

A sintered magnet of Nd—Fe—B is disclosed in European Laid Open Patent Application 0101552 A.

A bulk magnet of Nd—Fe—B type made from rapidly quenched metal flakes(Rapidly Quenched Type of Magnet, hereinafter) is disclosed in European Laid Open Patent Application 0108474 A.

Although these magnets have magnetic anisotropy and a high energy product of 25 MGOe or more, they are inferior to previous samarium-cobalt type of magnets with respect to corrosion resistance, because they include rare earth elements and iron, both of which are easily oxidized to cause, for example, red rust on their surface. The efficiency of the magnet and the uniformity of magnetic properties decreased when these magnets corrode.

In order to prevent corrosion of these Nd—Fe—B type of magnets, various methods are proposed to produce a corrosion resistive layer on their surfaces.

The idea of coating a resin layer on a surface of magnet material is disclosed in Japan Laid Open Patent Application 6377104. But generally the protective layer of resin is inferior to a metal plating layer. Because the resin layer is mechanically weaker than a metal plating layer, a scratch is easily made on the resin layer during handling and during insertion of the resin coated magnet into an electric equipment. The scratched portion of the resin layer becomes a starting point through which the magnet and the magnet material can be attacked. Even if the resin remains intact, it is inferior to a metal plating layer, because the resin layer is very hygroscopic. It is thus preferable to coat the surface of a magnet body with a metal plating film.

A nickel-plated layer is superior to an oxygen-resistant resin layer because the nickel layer itself is mechanically stronger and much less hygroscopic than a layer of resin.

However it is a problem that a nickel-plated layer typically has many pin holes in contrast to an oxygen-resist resin layer. Because of these pin holes a magnet body covered by the nickel layer is exposed to corrosion over time by water penetrating through the pin holes to the magnet body, even though the nickel layer itself is not hygroscopic.

The reliability of the corrosion resistive film is reduced if it cannot prevent attack on the substrate through pin-holes. When the substrate is attacked through pin-holes, corroded portions are produced on a magnet body under the protective film, even though the corrosion resistive film still seems to cover the surface of the magnet. It is important to compensate for the defects in the corrosion resistive metal film to protect the surface of magnets.

It seems that the prior art lacks disclosure of a technique to improve the bond between a protective layer on a magnet body and a part of an equipment in which it is to be installed by improving the surface characteristics of the corrosion resistive layer.

OBJECTS AND SUMMARY OF THE INVENTION

Accordingly, it is the object of the present invention to ensure good reliability of a corrosion resistive layer for a permanent magnet.

It is a further object of the invention to cover pin holes in a metal plating film.

It is a still further object of the invention to provide a coating technique for a permanent magnet wherein a metal plating film is deposited on a magnet body and a chromate coating is applied over the metal plating film.

It is a still further object of the invention to provide a coating technique for a permanent magnet consisting of first and second nickel coatings followed by a chromate coating. The chromate coating is effective to block pin-holes which may exist in the nickel coatings.

Briefly stated, the present invention provides a magnetically anisotropic magnet substrate that is coated with at least one layer of nickel plating followed by a chromate layer. The chromate top layer improves the corrosion resistance of the coated magnet substrate. In a preferred embodiment, the layer of nickel plating includes a first layer of a non-bright nickel plating followed by a second layer of a semi-bright nickel plating. One embodiment adds a copper under-layer below the nickel plating.

According to an embodiment of the invention, there is provided a surface treatment for a R—TM—X type of permanent magnet material comprising: mechanically working the material to form a magnet substrate, degreasing the magnet substrate, removing a surface layer of the magnet material, the quality of which is changed in the step of mechanically working, forming a non-bright nickel-plating of from about 1 to about 50 μm thickness on the magnet substrate, forming a semi-bright nickel plating of from about 0.5 to about 30 μm thickness on the non-bright nickel plating, forming a chromate layer of from about 0.0001 to about 10 μm thickness on the semi-bright nickel plating, and neutralizing the chromate layer using alkalines, where R represents an element or a mixture of rare-earth elements including yttrium, TM is composed of iron as its main component with other transition elements which can be partially replaced by other metal elements and/or other non-metal elements, and X represents an element or a mixture of elements such as B, Nb and other elements to enhance the coercive force of the magnet material.

According to a feature of the invention, there is provided a surface treatment for a R—TM—X type of permanent magnet material comprising: mechanically working the permanent magnet material to form a magnet substrate, degreasing the magnet substrate, removing a surface layer of the magnet material whose the quality has been changed during the step of mechanically working, nickel plating the magnet substrate to a 1.5 to 80 μm thickness of single bright Ni-layer, and coating a 0.0001 to 10 μm thickness chromate layer on the single bright nickel layer, where R represents an element or a mixture of rare-earth elements including yttrium, TM is composed of iron as its main component and other transition elements which can be partially replaced by other metal elements and/or other non-metallic elements, and X represents an element or a mixture of element as B, N and other elements to enhance the coercive force of the magnet material.

According to a further feature of the invention, there is provided a surface treatment for a R—TM—X type of permanent magnet material comprising: mechanically working the permanent magnet material to form a magnet substrate, degreasing the magnet substrate, removing a surface layer of the magnet material whose the quality has been changed during the step of mechanically working, nickel plating the magnet substrate to a 1.5 to 80 μm thickness consisting of a non-bright nickel under layer with a semi-bright nickel layer atop the non-bright nickel layer Ni-layer, and coating a 0.0001 to 10 μm thickness chromate layer on the semi-bright nickel layer, where R represents an element or a mixture of rare-earth elements including yttrium, TM is composed of iron as its main component and other transition elements which can be partially replaced by other metal elements and/or other non-metallic elements, and X represents an element or a mixture of elements such as B, N and other elements to enhance the coercive force of the magnet material.

According to a still further feature of the invention, there is provided a method for making a R—TM—X type of permanent magnet material comprising: rapidly quenching alloy flakes to produce a magnet material having an average crystal size of from about 0.02 to about 1.0 μm, hot working the magnet material by hot compression and a plastic deformation in a temperature ranging of from about 600° C. to about 800° C. to produce a magnetically anisotropic hot-worked magnet substrate, coating at least one coat of nickel plating on the magnet substrate, and applying a chromate coating over the at least one coat of nickel plating.

According to a still further feature of the invention, there is provided a surface treatment for a R—TM—X type of permanent magnet material comprising: compressing a magnetic material powder under a magnetic field to produce an anisotropic green shaped magnet substrate, sintering the green shaped magnet substrate to form a completed magnet substrate, removing a surface layer from the completed magnet substrate, coating the completed magnet substrate with at least one layer of a nickel plating, and coating the at least one layer of a nickel plating with a layer of chromate.

The above, and other objects, features and advantages of the present invention will become apparent from the following description.

DETAILED DESCRIPTION OF THE PREFERRED EMBODIMENTS

This invention is, for example a surface treatment for a R—TM—X type of permanent magnet comprising the steps, (1) removing a surface layer of the magnet material, the quality of which is changed by mechanical work.

(2) plating a non-bright nickel-plating to form a 1 to 50 μm thickness of non-bright Ni-layer on the magnet material, (3) plating a semi-bright nickel-plating to form a 0.5 to 30 μm thickness of semi-bright Ni-layer on the non-bright Ni-layer, (4) chromate treating the double-plated magnet material to form a 1 to 100 μm thickness of chromate layer, and (5) neutralizing the surface of the chromate layer using alkalines, where R represents an element or a mixture of rare-earth elements including yttrium, TM is a mixture, principally of iron, plus transition elements other than iron which can be partially replaced by other metal elements and/or other non-metallic elements, and X is one element or a mixture of elements such as B, N and other elements to enhance the coercive force of the magnet material.

In this invention a R—TM—X type of permanent magnet is metal plated and then coated by chromates. The chromate protective layer on the metal is very thin but is very adhesive to the underlying metal surface. Chromate is very effective for protecting the underlying metal surface from water, because it is amorphous, devoid of pin holes, and is water repellent. It is believed that the underlying metal would be protected even if the chromate film is partially destroyed since, at site of destruction, six charges of chromium ions come out from the chromate to suppress corrosion of the underlying metal. In this invention it is possible to enhance corrosion resistance of the protective layer on a R—TM—X type of magnet by the corrosion resistive characteristics of the chromate film.

The chromate treatment can be conducted by dipping the metal plated magnets in a chromate solution, after water cleaning of the metal plated magnets. The chromate treatment is preferably conducted at a temperature of from about 20° C. to about 80° C. with a dipping time of from about 1 to about 10 minutes.

A chromate solution is preferably a high acidic solution of chromic acid anhydride or dichromic acid, preferably with a chrome concentration of at least 0.01 mol/l. A low acidic chromate solution is not preferable because such a solution produces a non-water repelling chromate film.

It is preferable to use a high acidity of chromic acid also in order to produce an active dipping treatment. However, strong acids such as sulfuric acid, hydrochloric acid or nitric acid are omitted from the chromic acid solution. In the prior art, chromate solutions generally including a small amount of strong acid. But inclusion of a strong acid in the chromic acid solution for the present invention would cause too strong an activation of the chromic acid and may deposit a solution on the plated metal film on the magnet surface which would weaken the adhesion of the chromate film to the plated metal film. Moreover such a strong acid may corrode the magnet body if it penetrates through pin-holes in the plated metal film. So a strongly acidic chromate solution without using such a strong acid is preferable.

It is preferable to follow the chromate treatment by dipping the magnets in an alkaline solution. A preferable alkaline solution is a deliquescent solution containing sodium hydroxide or potassium hydroxide. An alkaline concentration of 3 wt % or more is sufficient to provide adequate washing ability. The dipping time is preferably from about 1 to about 10 minutes. The temperature of the alkaline solution is preferably from about 20° C. to about 80° C.

Then the magnets are then washed in water and dried at a temperature of 20° C. to 120° C. Since excessive heating of the magnets weakens the corrosion resistance of the chromate film, the drying temperature should not exceed about 120° C.

The neutralization-treatment by alkalines after the chromate treatment produces a stronger adhesion chromate layer to a bonding material which may be used to join the magnet to another part in an equipment.

The Ni-plating layer is preferably formed by electrolytic plating. The following solution constituents can be used for electrolytic plating. A bath includes from about 50 to about 500 g/l of a nickel salt containing one or a mixture of nickel ammonium sulfate, nickel sulfate, nickel chloride, sulfamic acid nickel, tetrafluoro-nickel borate, from about 10 to about 50 g/l of ammonium chloride, from about 10 to about 50 g/l of boric acid. If necessary, sodium lauryl sulfate or hydrogen peroxide may be included to prevent pits. To make the Ni-film semi-bright, the solution includes a first brightener such as benzene, naphthaline, saccharin and other material. To make the nickel film bright the solution includes further a second brightener such as butine-diol, coumarin, thio-urea and similar material.

The plating solution preferably has a temperature of 20° C. to 70° C. and a pH-value of 2.0 to 7.0. The cathode current density is preferably from about 0.1 to about 10 A/dm$^2$ (deci-meters squared). The Ni film produced by the plating solution contains mainly nickel but it can include a minor amount of impurities such as, for example, iron, copper, manganese, zinc, cobalt, carbon, and/or oxygen. The solution can contain alloying salts to produce a Ni-alloy film. The plated film can be a Ni alloy film including the added metals produced by adding nickel salt and other metal salt in the plating solution.

The element to be alloyed with nickel is generally an element or a mixture of Sn, Cu, Zn, Co, Fe, Cr, P, B and other metal elements. Since phosphor, a metalloid element, makes a plated Ni—P film amorphous, a Ni—P film is superior to a plated Ni film with respect to corrosion resistivity. The Ni—P film also has less pin-holes than a Ni plated film. Moreover the Ni—P film is mechanically stronger and more resistant to salt and other chemicals. A Ni—P plated film can generally be produced by non-electrolytic plating process. A plating solution may be, for example, a solution of nickel sulphate with hypophosphorous acid as an acetifier and acetate soda as a stabilizer. A Ni-base of multiple layers can provide a sacrifice anode effect by an inter-layer corrosion mechanism which is effective to improve the corrosion resistance of the layers.

A double layer of Ni-plated films is preferable, comprising an underlying layer of non-bright Ni-film and an over layer of semi-bright Ni-film. A single layer of non-bright Ni-plated film is not preferred because the protective layer composed of a single non-bright Ni-plated film and an over layer of chromate film is not sufficient to prevent corrosion of the magnet material.

A single layer of bright Ni-plated film gives satisfactory protection when covered by a chromate film. However, a single bright Ni plated layer needs a lot of time to form. The plating time can be shortened using a combination of a non-bright Ni-plating followed by a semi-bright Ni-plating, because a semi-bright plating needs a shorter plating time than a bright Ni-plating.

A double layer of a non-bright Ni-plated film and a semi-bright Ni-plated film also exhibits superior corrosion prevention. The underlying non-bright nickel layer is effective to combine with the magnet surface and with the overlying semi-bright nickel plated film. The overlying semi-bright nickel layer is effective to protect the underlying non-bright nickel layer from humidity, because it has fewer pin holes then does a nonbright nickel layer. The plating time required to form the Ni-double layer is shorter than the plating time to form a bright Ni-plated layer.

Adding a chromate film over the Ni-double layer remarkably enhances the resistance to corrosion.

The corrosion resistance is insufficient when the thickness of the underlying non-bright nickel film is less than 1 μm. On the contrary, the cost of material makes it preferable to keep the thickness of the non-bright nickel film less than 50 μm. A preferable thickness of the non-bright nickel-plating film is from about 5 μm to about 25 μm. A more preferable thickness of the non-bright nickel-plating film is from about 10 μm to about 20 μm.

The corrosion resistance is insufficient when the thickness of the overlying semi-bright nickel film is less than about 0.5 μm. On the contrary the cost of materials makes it preferable to keep the thickness of the semi-bright nickel film less than 30 μm. A preferable thickness of the semi-bright nickel-plating film is from about 1 μm to about 15 μm. A more preferable thickness of the non-bright nickel-plating film is from about 2 μm to about 10 μm.

In order to make a protective film on a magnet surface reliable, it is important to remove a surface layer whose quality has been changed by, for example, working or cutting.

Such a surface layer generally has a thickness of 5 μm to 20 μm. The surface layer is qualitatively changed by grinding, cutting or similar mechanical operations.

Previously it was tried to remove such a changed layer and to make the magnet surface active by etching with sulfuric acid or a similar acid before metal plating. This was unsuccessful since corrosion under the plating layer destroyed adhesion and permitted the plated metal film to be removed.

In this invention the surface layer is removed by a first etching using from about 0.2 to about 10 vol % of nitric acid followed by a second etching using a mixture of from about 0.2 to about 10 vol % of oxygenated water and from about 10 to about 30 vol % of acetic acid.

It is believed that the nitric acid removes the surface layer of the magnet material whose quality has been changed and that the mixture of oxygenated water and acetic acid makes the magnet surface active. These treatments enhance the adhesion of the metal film formed by a plating process to the magnet surface.

Copper-plating before the formation of Ni-plating layers is preferable to improve the corrosion resistance of the protective film on the surface of magnet material.

The copper plating before the nickel plating is effective to reduce the number of pin-holes in the plated nickel film and to improve the uniformity of the plated nickel film.

The plated copper layer under the plated nickel film improves plating ability of the nickel-plating solution. For example a complex-shaped magnet can be plated a uniform thickness of nickel because of the plated copper under layer. A plated copper under layer permits nickel plating a ring magnet.

A preferable thickness of the plated copper film is from about 0.5 μm to about 15 μm.

In this invention it is preferable that a corrosion resistant film is formed on surface of a magnet material comprising from about 5 to 40 wt % of R, 50–90 wt % of TM and 0.2 to 8 wt % of B and including 0.5 to 15 wt % of Co and 0.5 to 5 wt % of aluminum.

The grain boundary phase of a R—Fe—B type of magnet alloy comprises almost a rare-earth rich phase which includes several wt % of Fe and small amount of boron and a boron rich phase of $R_{1+C}TM_4B_4$ when the magnet does not include Co nor Al. The rare-earth rich phase degrades the corrosion resistance of the magnet due to its high chemical activity.

The problem of rare-earth richness at the grain boundaries of a R—Fe—B type of permanent magnet may be reduced by the addition of Co and Al to produce a multiple phase in the grain boundaries. By adjustment of the amount of Co and Al in the permanent magnet, it is possible to enhance the corrosion resistance of the magnet without reducing the magnetic properties. Co is effective to enhance its Curie temperature, the corrosion resistance of the magnet material and the magnetization value. However, less than 0.5 wt % of Co is not effective to enhance these properties. An amount of 15 wt % or more of Co reduces the coercive force iHc by causing precipitation of the R—Co compound comprising 40 wt % or more of Co caused by a high condensation of cobalt at the crystalline boundaries which make reverse of magnetization easier. The preferable range of Co amount is from about 0.5 wt % to about 15 wt % and most preferably from about 1 wt % to about 10 wt %.

Aluminum in addition to Co is effective to enhance iHc and corrosion resistance by preventing reduction of iHc that would be caused by an increase in the amount of Co in the magnet. Less than about 0.5 wt % of Al has reduced effectiveness in enhancing iHc and corrosion resistance. More than about 5 wt % of Al causes a sharp reduction in Br and (BH)max although it is still effective to increase iHc. The most preferable range of Al content is from about 0.5 wt % to about 5 wt %.

In the present invention the transition metal, TM, of the magnet material can include, other than Co and Al, the elements Ga, Ti, V, Cr, Mn, Zr, Hf, Nb, Ta, Mo, Ge, Sb, Sn Bi, Ni.

The present invention can be applied to permanent magnets produced by a powder metallurgy process or by a process comprising rapidly quenching a molten metal. The latter process generally comprises forming a powder by rapidly quenching the material in a hot atmosphere and compressing the powder to form a compressed body. Compressing is followed by hot working to provide the magnet body with a magnetic anisotropy caused by plastic deformation in the hot atmosphere. The formed bulk magnet is characterized by fine crystalline size of 0.02 μm to 1.0 μm. The magnet to be coated according to the present invention can be produced by the above-described, and any other modified process.

In order to improve corrosion resistance of the double nickel-plated layers, it is effective to treat the magnet with a chromate treatment by dipping the nickel-plated magnets in a solution including chromate oxide. The chromate film appears to block the pin holes existing in the nickel layers, thereby significantly reducing the problem of corrosion.

EXAMPLE 1

Firstly an ingot having a composition:

$Nd(Fe_{0.7}Co_{0.2}Bo_{0.07}Ga_{0.03})_{6.7}$, made by an arc-melting process, was pulverized to form a coarse powder by a stand-milling process and then by a disk-milling process. A fine powder of the alloy having an average particle size of 3.6 μm (FSSS) was produced by a jet-milling process using nitrogen gas as the grinding medium.

The fine powder was compressed to produce a green body while the powder was exposed to a magnetic field of 18 kOe in a direction perpendicular to the compression direction. The pressure for compression was 2.3 tons/cm$^2$. The green body was sintered in a vacuum for two hours at a temperature of 1100° C. The sintered body was cut to produce a test piece having a size of 20×12×6 mm. The test piece was cooled to near room temperature (150° C. is satisfactory)

The test piece was heated to a temperature of 900° C. for 2 hours in Ar atmosphere, and then cooled rapidly to 600° C. and then kept at 600° C. for one hour.

The test piece was surface-treated degreasing its surface with trichloroethane, then etching with a 1 vol % solution of nitric acid and then washing in water. After nitric acid etching, the piece was etched in a mixture of 5 vol % of hydrogen peroxide solution and 20 vol % of $CH_3COOH$ solution and then washed in water.

The etched body was plated to form a 3 μm thickness of copper, a 15 μm thickness of non-bright nickel film and a 5 μm thickness of semi-bright nickel film.

The doubly nickel plated magnet was then dipped in a chromic acid anhydride solution having a concentration of 6.0 g/l (pH=1.3) for 5 minutes at a temperature of 50° C.

The treated magnet exhibited the following magnetic properties.

Br(kG): 13.00
iHc(kOe): 16.50
(BH)max(MGe):37.0

It can be said that the magnet had excellent magnetic properties.

To evaluate the oxidation-resistance of the magnet we investigated the surface of the magnet by keeping it at a temperature of 120° C. and in 100% of humidity (PCT Test) for three days. The term "PCT Test" refers to an accelerated test procedure called a "pressure cooker test" in which the part is maintained in a pressure cooker at two atmospheres at the conditions noted.

After the above treatment, peeling scaling and flaking were tested in a "cross-hatch test". The surface layers of chromate, nickel and copper were scored in a cross-hatch pattern using a sharp knife. A piece of cellophane adhesive tape was adhered to the scored surface, and pulled away in a direction normal to the surface of the part, and the tape was visually examined for adhering flakes of the coating that may have been peeled off during pulling of the adhesive tape. No peeling or flaking was observed.

The surface of the surface was visually examined for evidence of red rust or other changes in the surface. No red rust or other changes were seen. The increase in oxides was only 0.002 mg/cm$^2$.

EXAMPLE 2

Firstly an ingot having a composition:

$(Nd_{0.8}Dy_{0.2})(Fe_{0.7}Co_{0.2}B_{0.07}Ga_{0.03})_{6.7}$, made by an arc-melting process, was pulverized to form a coarse powder by stand-milling followed by disk-milling. The coarse powder was further ground by jet-milling, using nitrogen gas as grinding medium, to produce a fine powder of the alloy having an average particle size of 3.6 μm as measured in a Fisher Sub-Seive Sizer (FSSS). The FSSS process is a standard industrial process for measuring particle size, and thus requires no further description.

The fine powder was formed into a green body in a magnetic field of 18 kOe applied perpendicular to the compression direction. The pressure for compression was 2.3 tons/cm$^2$. The green body was sintered in vacuum for two hours at a temperature of 1100° C. The sintered body was cut to produce test pieces having a size of 20×12×6 mm.

The test pieces were heated to a temperature of 900° C. for 2 hours in Ar atmosphere, cooled rapidly to 600° C., and then held at 600° C. for one hour. The test pieces were cooled and heat treated as in treatment No. 1 above.

The test pieces were surface-treated degreased in trichloroethylene, etched in a 3 vol % solution of nitric acid and then washed in water. Finally, the pieces were etched in a mixture of 8 vol % of hydrogen peroxide solution and 20 vol % of $CH_3COOH$ solution and then washed in water.

Then the test pieces were treated as follows.

Treatment No. 1

The test pieces were plated to form a 15 μm thickness of non-bright nickel film and a 5 μm thickness of semi-bright nickel film. After water-washing the doubly nickel plated pieces were then dipped in a solution including 10 g/l of $CrO_3$ at a temperature of 50° C. for 5 minutes. Then they were washed in water and dried.

Treatment No. 2

The test pieces were plated to form a 15 μm thickness of non-bright nickel film and a 5 μm thickness of semi-bright nickel film. After water-washing the doubly nickel plated pieces were then dipped in a solution including 15 g/l of $Na_2Cr_2O_7$ at a temperature of 50° C. for 5 minutes. Then they were washed in water and dried.

Treatment No. 3

The test pieces were plated to form a 20 μm thickness of bright nickel film. Then they were washed in water and dried.

Treatment No. 4

The test pieces were plated to form a 15 μm thickness of non-bright nickel film and a 5 μm thickness of bright nickel film. After water-washing the doubly nickel plated pieces were dried.

These treated pieces were given a corrosion test. The samples were exposed to a temperature of 80° C. at one atmosphere of pressure and 90% of humidity. The surface was thoroughly examined visually for the presence of red rust on the magnets caused by oxidization.

No red rust was found on the samples treated by treatment Nos. 1 and 2 even after 1000 hours of exposure to the test conditions. The samples treated by the treatment No. 3 showed some stains after 100 hours and red rust points after 200 hours. The samples treated by the treatment No. 4 showed some stains after 150 hours, and red rust points after 500 hours.

These samples were also examined after a salt water spray test using 5 vol% of NaCl solution at a temperature of 35° C. for 200 hours. No red rust was observed on the surface of the samples treated by the treatment Nos, 1 and 2 after the 200 hours of salt water spray test. On the other hand the samples treated by the treatment No. 3 showed red rust after 12 hours of salt water spray test. The samples treated by the treatment No. 4 showed red rust after 30 hours of salt water spray test.

A comparison of the above treatments shows that the presence of the chromate film covering the metal-plated film on the magnet surface improves the resistance to corrosion of the R—TM—B magnets.

EXAMPLE 3

Firstly an ingot having a composition:

$(Nd_{0.8}Dy_{0.2})(Fe_{0.7}Co_{0.2}Bo_{0.07}Ga_{0.02}Nb_{0.01})_{6.7}$, made by arc melting, was pulverized by stand milling and then by disk-milling to form a coarse powder. The coarse powder was further pulverized by jet milling, using nitrogen gas as grinding medium, to produce a fine powder of the alloy having an average particle size of 3.6 μm measured by the FSSS process.

The fine powder was compressed in a magnetic field of 18 kOe, perpendicular to the compression direction, to produce a green body. The pressure for compression was 2.3 tons/cm$^2$. The green body was sintered in vacuum for two hours at a temperature of 1100° C. The sintered body was cut to produce test pieces having a size of 20×12×6 mm. The test pieces were cooled to about 150° C. and ground to shape.

The test pieces were heated to a temperature of 900° C. for 2 hours in Ar atmosphere, and then cooled rapidly to 600° C. and then held at 600° C. for one hour.

The test pieces were surface degreased in trichloroethane, etched in a 5 vol % solution of nitric acid and then washed in water. Then the pieces were etched in a mixture of 10 vol % of hydrogen peroxide solution and 20 vol % of $CH_3COOH$ solution and then washed in water.

Then, the test pieces were respectively treated as follows.

Treatment No. 5

The test pieces were plated to form a 15 μm thickness of non-bright nickel film and a 5 μm thickness of semi-bright nickel film. After water-washing the doubly nickel plated pieces were dipped in a solution including 10 g/l of $CrO_3$ at a temperature of 50° C. for 5 minutes. Then they were dipped in a solution including 50 g/l of NaOH at a temperature of 20° C. for one minute. After water-washing they were dried.

Treatment No. 6

The test pieces were plated to form a 15 μm thickness of non-bright nickel film and a 5 μm thickness of semi-bright nickel film. After water-washing, the doubly nickel plated pieces were dipped in a solution including 10 g/l of $CrO_3$ at a temperature of 50° C. for 5 minutes. Then they were dipped in a solution including 50 g/l of KOH at a temperature of 20° C. for one minute. After water-washing they were dried.

Treatment: No. 7

The test pieces were plated to form a 15 μm thickness of non-bright nickel film and a 5 μm thickness of semi-bright nickel film. After water-washing the doubly nickel plated pieces were dipped in a solution including 15 g/l of $Na_2Cr_2O_7$ at a temperature of 50° C. for 5 minutes. Then they were dipped in a solution including 50 g/l of NaOH at a temperature of 20° C. for one minute. After water-washing they were dried.

Treatment No. 8

The test pieces were plated to form a 15 μm thickness of non-bright nickel film and a 5 μm thickness of semi-bright nickel film. After water-washing, the doubly nickel plated pieces were dipped in a solution including 10 g/l of $CrO_3$ at a temperature of 50° C. for 5 minutes. Then they were washed in water and dried.

Treatment No. 9

The test pieces were plated to form a 15 μm thickness of non-bright nickel film and a 5 μm thickness of semi-bright nickel film. After water-washing the doubly nickel plated pieces were dipped in a solution containing 15 g/l of $Na_2Cr_2O_7$ at a temperature of 50° C. for 5 minutes. Then they were washed in water and dried.

The samples treated by the treatment Nos. 5, 6 and 7 exhibited several times the bond strength of samples treated by treatments 8 and 9. Bond strength was tested by scoring a cross hatch pattern of lines through the coating surface with a sharp knife, adhering a strip of cellophane adhesive tape and pulling the tape away perpendicular to the surface. The adhesive tape was examined visually for evidence of particles remaining adhered thereto.

It is common industry practice to coat magnets with an epoxy resin film in order to improve their resistance to moisture and corrosion. In one technique, magnets may be coated by electrodeposition with a coating of POWERCHRON 500 epoxy resin available commercially from PPG Corp. It has been observed that, absent the final treatment with alkalines, substantial pitting is found in the epoxy coating. In some cases, the pitting penetrates completely through the epoxy coating to the layer below it. Such pitting, since it exposes the lower layer, acts contrary to the intention to protect the lower layers against attack by moisture. Samples treated by treatment Nos. 8 and 9 were coated with an epoxy resin coating by electrodeposition. A visual examination of the epoxy coating on these samples disclosed many pit defects. Samples treated by the treatment Nos. 5, 6 and 7 and coated with an epoxy resin by electrodeposition showed a smooth surface with no pit defects in the epoxy coating.

It is believed that the chromate coating may be a cause of the pitting observed in the epoxy coating occurring in the absence of alkaline treatment following the chromate coating. The nature of the material below the chromate coating may not affect this phenomenon. Thus, chromate coating, alkaline neutralization, followed by epoxy resin electrodeposition may be a useful treatment for metallic substrates other than nickel-plated permanent magnets.

Permanent magnets produced according to the present invention exhibit excellent resistance to corrosion and also excellent magnetic properties compared to previously known magnets.

Magnets coated with double layers of a non-bright Ni-plated film and a semi-bright Ni-plated film are effective to protect the magnet from corrosion. The greatest protection is found when the doubly Ni-plated magnet is given a chromate coating. It is believed that the semi-bright film prevents the underlying non-bright nickel film from absorbing humidity under the layer of chromates.

Having described preferred embodiments of the invention, it is to be understood that the invention is not limited to those precise embodiments, and that various changes and modifications may be effected therein by one skilled in the art without departing from the scope or spirit of the invention as defined in the appended claims.

What is claimed is:

1. A surface treatment for a R—TM—X type of permanent magnet material comprising:

mechanically working said permanent magnet to form a magnet substrate;

degreasing said magnet substrate;

removing a surface layer of said magnet substrate, whose quality is changed in the step of mechanically working, by a first etching, using from 0.2 to 10 vol % of a nitric acid, and a second etching, using a mixture of 0.2 to 10 vol % oxygenated water and from 10 to 30 vol % of an acetic acid;

forming a non-bright nickel-plating, of from about 5 to about 25 μm thickness, on said magnet substrate;

forming a copper layer on said magnet substrate prior to the step of forming said non-bright nickel layer;

forming a semi-bright nickel plating, of from about 1 to about 15 μm thickness, on said non-bright nickel plating;

forming a chromate layer, of from about 0.0001 to about 10 μm thickness, on said semi-bright nickel plating;

said step of forming a chromate layer includes a chromate treatment comprising dipping said magnet in a chromate solution, wherein said chromate solution is acidic consisting essentially of at least one of chromic acid anhydride and dichromic acid with a chrome concentration of at least 0.01 mol/l; and neutralizing said chromate layer using alkalines;

said step of neutralizing said chromate layer includes immersing said magnet in a deliquescent solution containing at least one of a sodium hydroxide and potassium hydroxide;

where R is at least one of about 5 to 40 wt % of an element and a mixture of Nd, Pr, and Dy, TM comprises iron and one of from about 0.5% to about 15 wt % of Co and from about 0.5 wt % of Al, and X is at least one of about 0.2 to 8 wt % of an element and a mixture of elements comprising B and N.

2. A surface treatment for a R—TM—X type of permanent magnet material according to claim 1 wherein:

said TM includes from about 1 to about 10 wt % of Co.

3. A surface treatment for a R—TM—X type of permanent magnet material according to claim 1 wherein said non-bright nickel plating has a thickness of from about 10 μm to about 20 μm and said semi-bright nickel plating has a thickness of from about 2 μm to about 12 μm.

4. A surface treatment for a R—TM—X type of permanent magnet material comprising:

mechanically working said permanent magnet material to form a magnet substrate;

degreasing said magnet substrate;

removing a surface layer of the magnet material whose quality has been changed during the step of mechanically working;

forming a copper layer on said magnet substrate prior to the step of nickel plating said magnet substrate;

nickel plating said magnet substrate to a 1.5 to 80 μm thickness consisting of a non-bright nickel under layer with a semi-bright nickel layer atop said non-bright nickel layer;

coating a 0.0001 to 10 μm thickness chromate layer on said single bright nickel layer; and neutralizing said chromate layer using alkalines;

where R represents an element or a mixture of rare-earth elements including yttrium, TM is comprised of iron and at least one of metal elements and a mixture of non-metallic elements, and X represents at least one of an element and a mixture of elements comprising B and N that enhance a coercive force of the magnet material.

5. A surface treatment for a R—TM—X type of permanent magnet material comprising:

compressing a magnetic material powder under a magnetic field to produce an anisotropic green shaped magnet substrate;

sintering said green shaped magnet substrate to form a completed magnet substrate;

removing a surface layer from said completed magnet substrate;

coating said completed magnet substrate with a double layer of nickel plating comprising a non-bright layer of nickel plating and a semi-bright layer of nickel plating;

coating said double layer of nickel with a layer of chromate; and neutralizing said chromate layer using alkalines.

6. A surface treatment for a R—TM—X type of permanent magnet material according to claim 1 wherein:

said TM further includes at least one of Ga, Ti, Cr, Mn, Zr, Hf, Nb, Ta, Mo, Ge, Sb, Sn, Bi and Ni.

7. A surface treatment for a R—TM—X type of permanent magnet material according to claim 1 wherein said copper layer is from about 0.5 to about 15 μm thickness.

* * * * *